US005361930A

United States Patent [19]

Perry

[11] Patent Number: 5,361,930

[45] Date of Patent: Nov. 8, 1994

[54] TWO-PIECE NESTABLE SEPTIC TANK WITH INTEGRAL ANTIFLOATATION COLLAR

[76] Inventor: Carlos Perry, 8012 Centreville Rd., Manassas, Va. 22111

[21] Appl. No.: 208,815

[22] Filed: Mar. 11, 1994

[51] Int. Cl.[5] ..... B65D 8/04

[52] U.S. Cl. ..... 220/565; 220/4.12; 220/4.21; 220/694

[58] Field of Search ..... 220/4.21, 565, 4.12, 220/694

[56] References Cited

U.S. PATENT DOCUMENTS

| | | | |
|---|---|---|---|
| 4,159,781 | 7/1979 | Bartlow | 220/4.21 |
| 4,231,482 | 11/1980 | Bogan | 220/4.21 |
| 4,333,580 | 6/1982 | Sweigart, Jr. | 220/4.21 |
| 4,494,650 | 1/1985 | Cullen | 220/4.21 |
| 4,595,037 | 6/1986 | LeBreton et al. | 220/4.21 |

*Primary Examiner*—Joseph Man-Fu Moy

*Attorney, Agent, or Firm*—Whitham, Curtis, Whitham & McGinn

[57] ABSTRACT

A septic tank is constructed from top and bottom shells. The top and bottom shells are nestable within like top and bottom shells in order to allow greater numbers of septic tanks to be shipped one a cargo truck or railroad car. In a preferred embodiment, both the top and bottom shells have peripheral flanges that interlock together. The septic tank is assembled at its sight of intended use by placing the top and bottom shells together, inserting a gasket material between the interlocking peripheral flanges, and affixing a plurality of clips over the interlocking peripheral flanges to hold the top and bottom shells together. Preferably, the peripheral flanges serve the function of an integral antifloatation collar for the septic tank. The antifloatation collar increases the cross sectional area of the septic tank over which soil is applied, and allow the tank to be firmly held in the ground without the use of an anchor or ground screw.

7 Claims, 5 Drawing Sheets

TWO-PIECE NESTABLE SEPTIC TANK WITH INTEGRAL ANTIFLOATATION COLLAR

BACKGROUND OF THE INVENTION

1. Field of the Invention

The invention is generally related to septic tanks and, more particularly, to septic tanks of two piece construction and to a means for maintaining a septic tank firmly within the ground without the use of an anchor or ground screw.

2. Description of the Prior Art

Septic tanks are typically used at dwellings which are not connected to public water and sewer facilities. The septic tank is located underground and is basically a batch sewage processor. Sewage from the dwelling is sent to the septic tank where it is acted on by microorganisms. Through biochemical reactions, the sewage is decomposed. Subsequently, liquid and gaseous effluent is discharged into the surrounding soil. Solids remaining within the tank are periodically cleaned to prevent scum and sludge from backing up into the home.

Because the septic tank is essentially a hollow compartment for receiving fluids, there will be a tendency for it to lift up out of the more dense surrounding ground. The "buoyancy" of the septic tank is especially pronounced in tanks made from fiberglass, plastics, and resin materials, as opposed to concrete. To counteract the "buoyancy force", tanks are often anchored or held to the ground using a ground screw.

Septic tanks are typically transported by truck in unitary form. Thus, the truck is carrying mostly air, since the inside of the septic tank is hollow. U.S. Pat. No. 4,961,670 to McKenzie et al. and U.S. Pat. No. 5,242,584 to Hoarau show typical examples of unitary, molded septic tanks. It would be advantageous to design the septic tank to be transportable as two or more component parts where the component parts can be nested together during transport, and subsequently assembled together on-site prior to installation. This type of design should allow many more septic tanks to be transported by the same truck than occurs with current practice. U.S. Pat. No. 4,325,823 to Graham and U.S. Pat. No. 4,886,605 to Herve show septic tank designs where the tanks are assembled from separately manufactured top and bottom sections. However, the Graham and Herve septic tank designs do not allow on-site assembly of the septic tank. Hence, the Graham and Herve designs do not allow for the transport of additional septic tanks on a truck.

U.S. Pat. No. 3,426,903 to Olecko discloses a multicomponent septic tank and specifically shows the entire assembly in a nesting or packaged configuration in FIG. 2. The nesting configuration of Olecko essentially allows a single septic tank to occupy half the space it would otherwise occupy if it were fully assembled. It would be advantageous to have a nesting scheme which allowed for more dense packing of septic tanks for transportation purposes than is allowed by the Olecko design.

SUMMARY OF THE INVENTION

It is an object of this invention to provide a two-piece nestable septic tank with an integral antifloatation collar.

According to the invention, a septic tank is designed to be constructed on-site from individual top and bottom shells. The top and bottom shells are nestable with other, like, top and bottom shells, such that multiple septic tanks can be carried on the same truck, rail car, or other transport vehicle. The septic tank includes an integral collar which helps offset the buoyancy force exerted on the tank, and assures that the septic tank will not float upwards in the soil without the use of an anchor or ground screw. In a preferred embodiment, the top and bottom shells include peripheral flanges that interlock together to assemble the septic tank and which, once the septic tank is assembled, function as the integral antifloatation collar for the septic tank.

BRIEF DESCRIPTION OF THE DRAWINGS

The foregoing and other objects, aspects and advantages will be better understood from the following detailed description of the preferred embodiments of the invention with reference to the drawings, in which.

Figure 9:
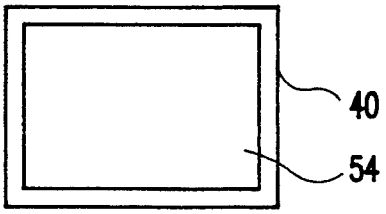

FIGS. *7a* and *7b* are cross-sectional side views of a hexagonal shaped septic tanks underground where FIG. *7a* shows a septic tank without an antifloatation collar and FIG. *7b* shows a septic tank with an antifloatation collar positioned in the middle of the tank;

FIG. *8a* and *8b* are cross-sectional side views of a box shaped septic tanks underground where FIG. *8a* shows a septic tank without an antifloatation collar and FIG. *8b* shows a septic tank with an antifloatation collar positioned at the base of the tank; and FIG. 9 is a schematic top view of a septic tank showing the enlargement of the cross-sectional area exposed to the downward force of soil and rock when an antifloatation collar is provided.

DETAILED DESCRIPTION OF THE PREFERRED EMBODIMENTS OF THE INVENTION

Figure 1:
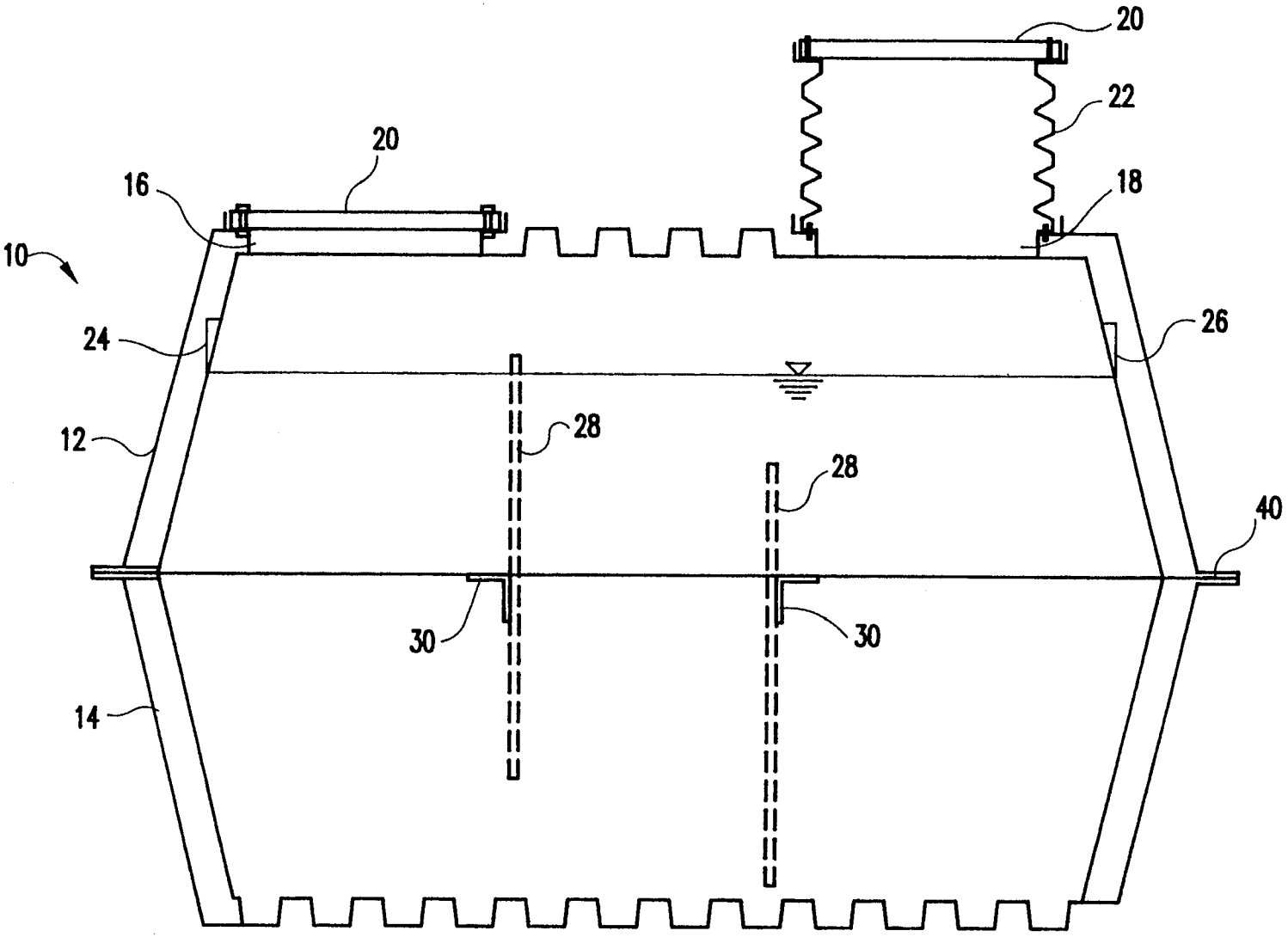
FIG. 1 is a side view of a preferred septic tank according to the present invention.
Figure 2:
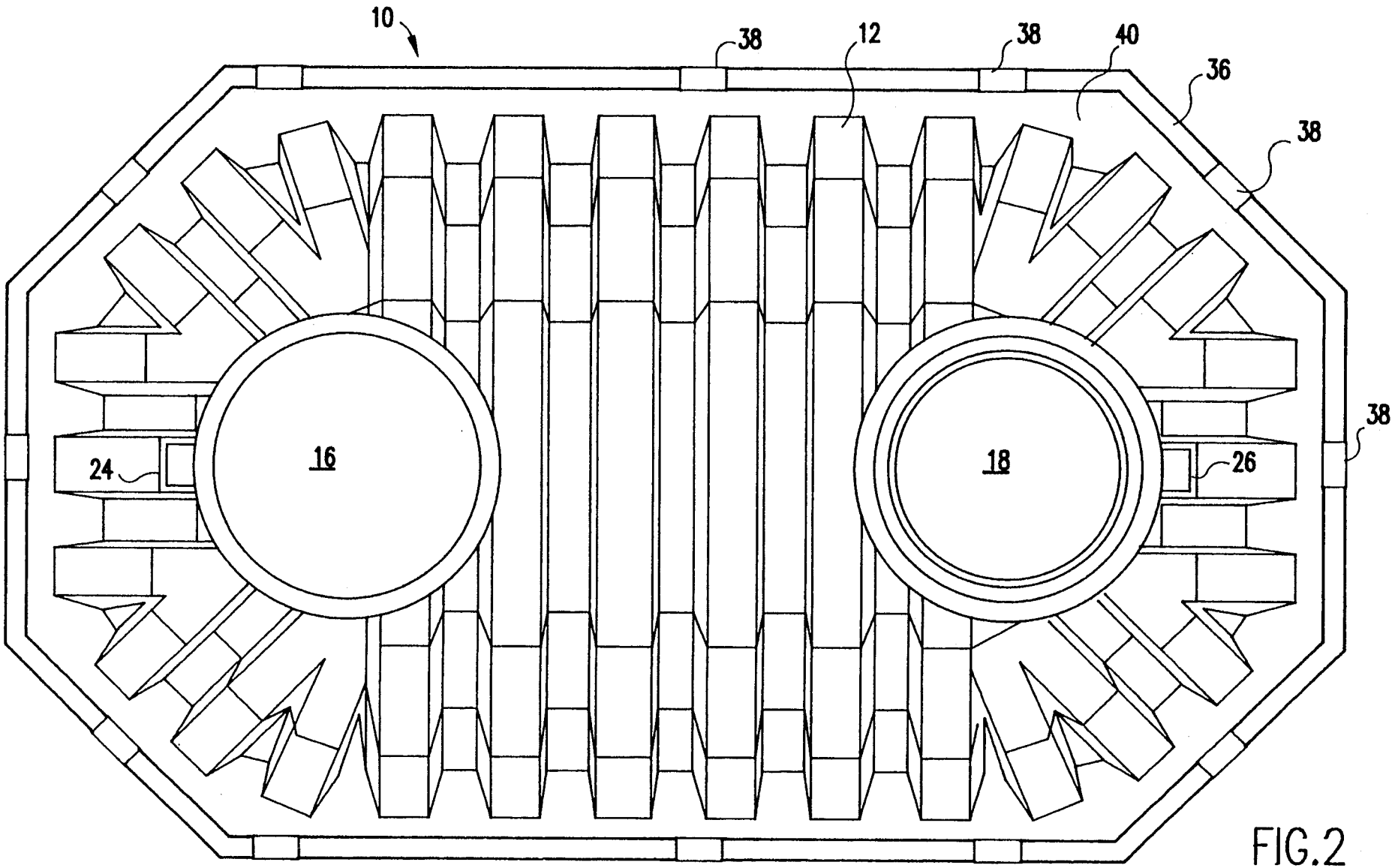
FIG. 2 is a top view of the septic tank shown in FIG. 1.
Figure 3:
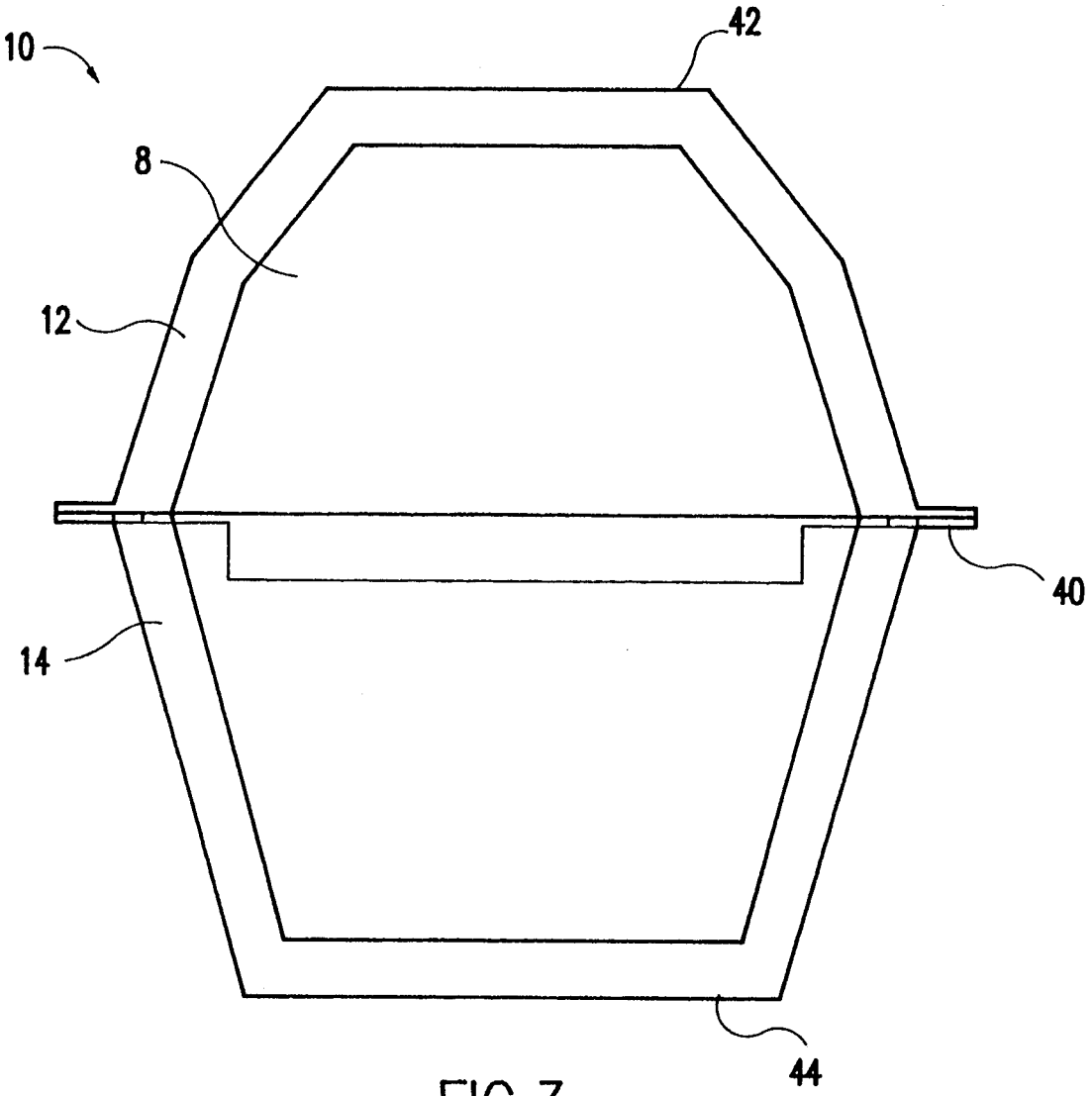
FIG. 3 is a cross-sectional view of the septic tank shown in FIG. 1.

FIGS. 1, 2, and 3 show side, top, and cross-sectional views, respectively, of a preferred septic tank 10 according to the invention. It should be understood that the shape of the septic tank 10 can vary considerably within the practice of the invention. The septic tank 10 is made from sturdy plastic materials that are preferably reinforced with glass, carbon, or other fiber materials. The main hollow housing 8 of the septic tank 10 is constructed from two different components which are identified as top 12 and bottom 14 shells. The septic tank 10 has access ports 16 and 18 which are preferably covered with, a bolted, gasketed, water tight plastic manhole cover 20. Risers 22 can be used to connect the septic tank 10 to the ground surface. Inlet 24 and outlet 26 ports allow raw sewage to be transported into the septic tank 18 and gas and liquids to be transported out.

Baffles 28, struts 30, and other elements may be positioned inside the septic tank 10 depending on the needs of the installation. Corrugating the surfaces of the septic tank 10, as shown in FIGS. 1–3 can provides enhanced rigidity.

Figure 4:
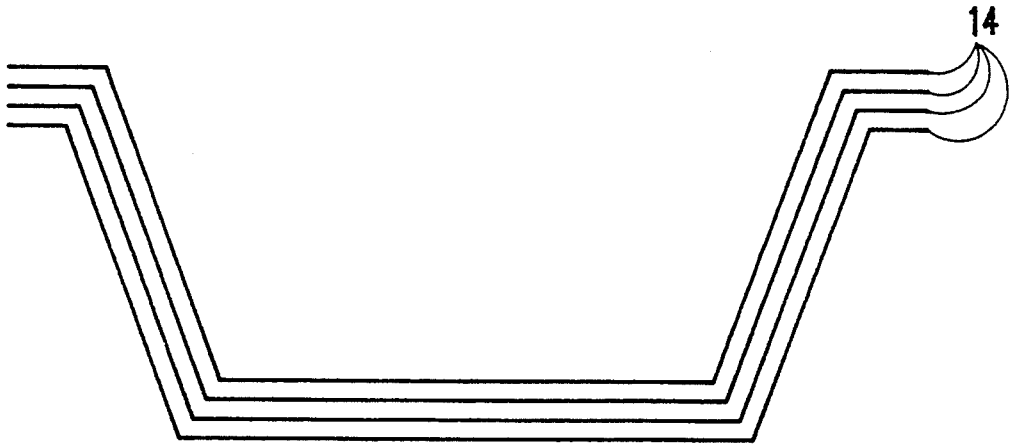
FIG. 4 is a schematic of several bottom shells which are used to form the septic tank of FIG. 1 that illustrates a nesting feature of the present invention.
Figure 5:
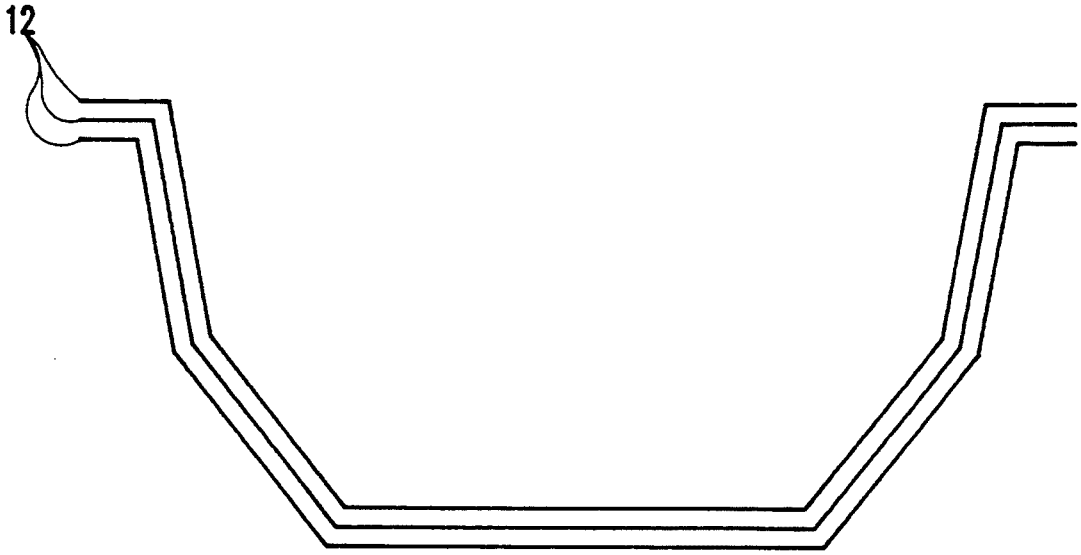
FIG. 5 is a schematic of several top shells which are used to form the septic tank of FIG. 1 that illustrates a nesting feature of the present invention.

FIGS. 4 and 5 illustrate the "nesting" aspect of the present invention. FIG. 4 shows a plurality of bottom shells 14 can be stacked within one another, and FIG. 5 shows a plurality of top shells 12 can be stacked within one another. Normally, septic tanks are of unitary construction and, generally, trucks can transport only 15–18 septic tanks due to their size. The tanks of the present invention should be 0.25 to 1 inch thick, and the top and bottom shells are on the order of three feet high, eleven to twelve feet long, and five to six feet wide; however, the dimensions of the tanks and shapes of the tank shells can vary widely. By providing the tanks in two pieces, several more tanks can be carried per truck load. For example, by having the tops and bottoms nestable together as shown in FIGS. 4 and 5, a single truck which ordinarily carries 15–18 septic tanks should be able to carry the tops and bottoms for 250 to 300 septic tanks.

Figure 6:
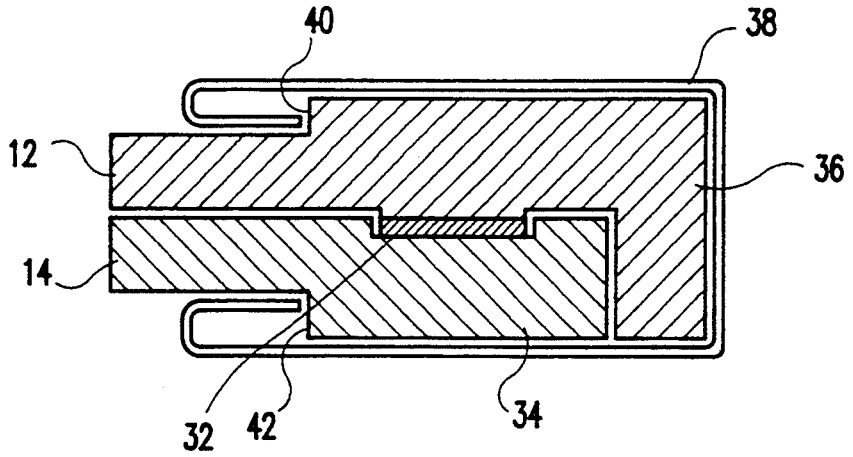
FIG. 6 is a cross-sectional side view of the preferred interlocking flanges of the top and bottom shells which join the two shells and create 20 the antifloatation collar of the present invention.

FIG. 6 illustrates a preferred configuration for connecting the top 12 and bottom 14 shells. Each shell has a flange which projects outward from the edge of the shell. The flanges are constructed to interlock with one another to provide a tight fit. A gasket material 32 fits in a channel created between the interlocking portions 34 and 36 of the flanges to make the septic tank fluid tight. A metal clip 38 fits over the interlocking portions 34 and 36 and fastens against abutments 40 and 42 to firmly hold the top and bottom shells together. FIG. 2 shows that a plurality of metal clips 38 are used around the periphery of the septic tank 10. The interconnection scheme provides a quick and reliable means for joining the top and bottom shells together at the site of septic tank installation.

FIGS. 1, 2 and 3 show a preferred embodiment of the invention where the flanges which interconnect the top 12 and bottom 14 shells form an antifloatation collar 40 about the periphery of the septic tank 10. The antifloatation collar 40 serves the purpose of firmly holding the septic tank 10 in the ground in wet and dry soil without the use of an anchor or ground screw. As can be seen from FIGS. 1 and 3, the antifloatation collar 40 projects outwardly from the side wall of the septic tank 10 in a plane that is parallel to the top 42 and bottom 44 of the tank 10. The antifloatation collar 40 must be rigid enough to withstand bending under the influence of buoyancy forces that would otherwise lift the tank out of the ground. In the preferred embodiment, the antifloatation collar is molded simultaneously with the tank shells using the same material, which is ideally a fiber reinforced plastic. The tank thus produced, has an antifloatation collar that is twice the thickness of the tank walls.

Figure 7A:
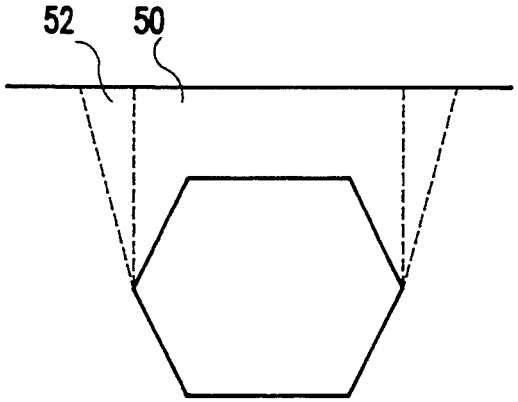
Figure 7B:
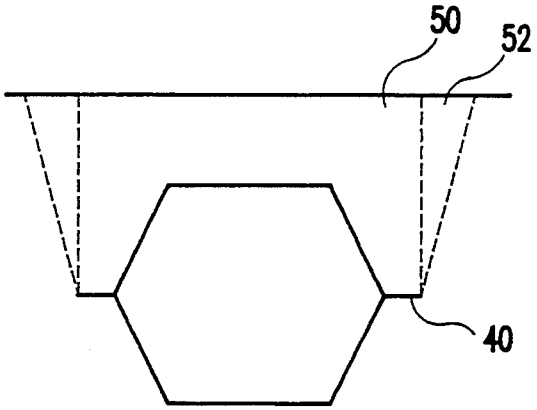
Figure 8A:
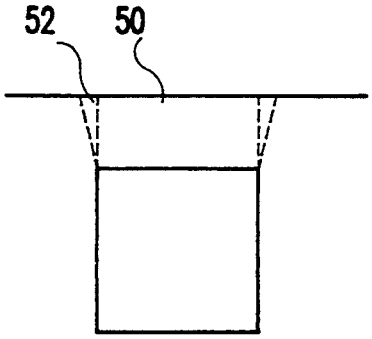
Figure 8B:
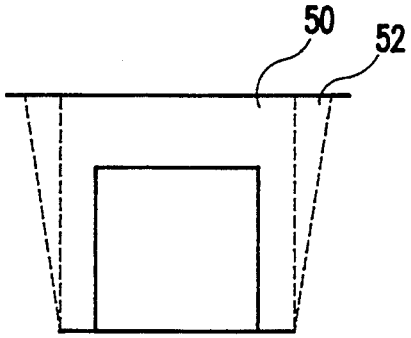

FIGS. 7*a–b*, 8*a–b*, and 9 illustrate the function of the antifloatation collar 40. The principle of operation is the same for different shaped tanks and for different positions of the antifloatation collar on the side wall periphery of the tank FIGS. 7*a* and 7*b* show a septic tank with a hexagonal cross-section and FIGS. 8*a* and 8*b* show a septic tank with a square cross-section. In order to accommodate a nesting function, the tank of FIGS. 8*a* and 8*b* should be slightly trapezoidal in shape. FIG. 7*b* shows the antifloatation collar 40 projecting outward from the center section of the tank side wall, while FIG. 8*b* shows the antifloatation collar 40 projecting outward from the bottom section of the tank side wall. To counteract buoyancy of the tank, the antifloatation collar must be greater in cross-section than the cross-section defined by the largest perimeter around the side walls of the tank.

All septic tanks will have a downward force spread across the top of the tank which is exerted by the overlying soil and rock. Due to the soil shear force, the downward force is greater than simply the volume directly above the tank. As can be seen from FIGS. 7*a–b* and FIGS. 8*a–b*, the "overburden force", Fob, which acts against the top surface of the tank includes both the soil 50 directly above the tank and soil 52 spreading from the outer periphery of the tank in a tapered fashion which accounts for the shear stress of the soil. In addition, the gravitational force, Ft, which acts on the tank itself provides a downward component. Equation 1 provides a summary of the total downward force, Fd, acting on the tank.

$$Fd = Fob + Ft \qquad \text{Eq 1}$$

Once installed in the ground, all tanks will experience an upward acting buoyancy force, Fb, which is the product of the volume of the tank and the density of the fluid within the tank. This is because the density of the fluid inside the tank is less than the density of the surrounding soil.

Equation 2 dictates that when the downward forces, Fd, exceed the buoyancy forces, Fb, the tank will not rise in the soil.

$$Fd > Fb;\ \text{tank remains in place} \qquad \text{Eq 2}$$

Because of the relative "lightness" of plastic septic tanks compared to concrete tanks, there is a greater propensity for the plastic septic tanks to be forced from the earth. This is because the gravitational force, Ft, is significantly less for plastic tanks than for concrete. As a result, plastic septic tanks have required the use of a ground screw or anchor to maintain the tank within the ground. This invention contemplates using an antifloatation collar 40 to increase the cross-sectional area of the tank which correspondingly increases the downward force, Fd.

FIG. 9 shows that the antifloatation collar 40 has a greater outer perimeter than the largest outer perimeter 54 around the side walls of the tank. Therefore, the antifloatation collar 40 increases the cross-sectional area of the tank subjected to the downward forces of the soil, Fob. The Fob is a function of the soil density as well as the depth at which the septic tank is submerged. In addition, the density of the soil changes depending on whether it is dry or wet. As such, the antifloatation collar should be of sufficient size to prevent floatation of the septic tank in both dry and wet soils. In order to satisfy the requirements of most septic tank installation sites, the cross-sectional area defined by the outer perimeter of the antifloatation collar should be at least 2–3% greater than the cross-sectional area defined by the greatest perimeter around the side walls of the septic tank. For example, a three to six inch antifloatation collar would be suitable for a septic tank having eleven to twelve foot by six to eight foot length and width dimensions, respectively.

While the invention has been described in terms of its preferred embodiments, those skilled in the art will recognize that the invention can be practiced with modification within the spirit and scope of the appended claims.

I claim:

1. A septic tank, comprising:

a hollow housing for holding a volume of liquid, said hollow housing having a top, a bottom, and a plurality of side walls connecting said top and said bottom, said hollow housing having a first perimeter that is the greatest distance around an outside surface of said plurality of side walls;

means for admitting liquid into and withdrawing liquid from said hollow housing; and an antifloatation collar integral with said hollow housing which projects from said outside surface of said plurality of side walls in a plane that is parallel to said top and said bottom of said hollow housing to a second perimeter which is greater than said first perimeter that is the greatest distance around said outside surface of said plurality of side walls, said antifloatation collar being of sufficient rigidity to resist bending under the influence of buoyancy forces exerted on said bottom of said hollow housing, said second perimeter of said antifloatation collar being of a size sufficient to prevent floatation of said hollow housing in dry and saturated soils.

2. The septic tank of claim 1 wherein said hollow housing defines a first cross-sectional area within said first perimeter that is the greatest distance around said outside surface of said plurality of side walls, and wherein said hollow housing and said antifloatation collar define a second cross-sectional area within said second perimeter, said second cross-sectional area being at least two percent greater than said first cross-sectional area.

3. The septic tank of claim 2 wherein said anti-floatation collar projects from said outside surface of said plurality of side walls at a point on said plurality of side walls that is between said top and said bottom of said hollow housing.

4. The septic tank of claim 2 wherein said anti-floatation collar projects from said outside surface of said plurality of side walls at a point on said plurality of side walls that is adjacent said bottom of said hollow housing.

5. The septic tank of claim 2 wherein said hollow housing is assembled from two separate components comprising top and bottom shells, said top and bottom shells being nestable with like top and bottom shells.

6. The septic tank of claim 5 wherein said top and bottom shells each include peripheral flanges, said peripheral flange of said top shell interlocking with said peripheral flange of said bottom shell to form said antifloatation collar, and further comprising a gasket which fits between said peripheral flanges of said top and bottom shells, and a plurality of metal clips, each of said metal clips being sized to fit over both said top and bottom peripheral flanges to hold said top and bottom peripheral flanges together.

7. The septic tank of claim 1 wherein said hollow housing has a length dimension of approximately eleven to twelve feet, and width dimension of approximately six to eight feet, and wherein said antifloatation collar is three to six inches.

* * * * *